US009495925B2

(12) United States Patent
Watanabe et al.

(10) Patent No.: US 9,495,925 B2
(45) Date of Patent: Nov. 15, 2016

(54) DISPLAY DEVICE AND SOURCE DRIVER

(71) Applicant: LAPIS SEMICONDUCTOR CO., LTD., Kanagawa (JP)

(72) Inventors: Yukinobu Watanabe, Kanagawa (JP); Yuichi Matsushita, Kanagawa (JP)

(73) Assignee: LAPIS SEMICONDUCTOR CO., LTD., Kanagawa (JP)

( * ) Notice: Subject to any disclaimer, the term of this patent is extended or adjusted under 35 U.S.C. 154(b) by 46 days.

(21) Appl. No.: 14/298,989

(22) Filed: Jun. 9, 2014

(65) Prior Publication Data

US 2014/0375625 A1 Dec. 25, 2014

(30) Foreign Application Priority Data

Jun. 20, 2013 (JP) ..... 2013-130017

(51) Int. Cl.
*G09G 3/36* (2006.01)

(52) U.S. Cl.
CPC ..... *G09G 3/3614* (2013.01); *G09G 3/3677* (2013.01); *G09G 3/3688* (2013.01); *G09G 2310/0283* (2013.01); *G09G 2320/02* (2013.01)

(58) Field of Classification Search
None
See application file for complete search history.

(56) References Cited

U.S. PATENT DOCUMENTS 7,612,789 B2 * 11/2009 Minami ..... G09G 5/006 345/204
7,936,328 B2 * 5/2011 Furihata ..... G09G 3/2011 345/89
7,965,271 B2 * 6/2011 Fan ..... G09G 3/3611 345/98
8,072,404 B2 * 12/2011 Watanabe ..... G09G 3/3688 345/100
8,077,135 B2 * 12/2011 Hsu ..... G09G 3/3688 345/100
8,823,626 B2 * 9/2014 Minami ..... G09G 3/3648 345/100
8,922,473 B2 * 12/2014 Iwamoto ..... G09G 3/3611 345/100
9,099,026 B2 * 8/2015 Shiibayashi ..... G09G 5/10
2008/0278463 A1 * 11/2008 Chen ..... G09G 3/3648 345/204
2009/0021462 A1 * 1/2009 Furihata ..... G09G 3/2011 345/89
2009/0219276 A1 * 9/2009 Hirama ..... G09G 3/3688 345/213
2009/0295777 A1 * 12/2009 Wang ..... G09G 3/3614 345/212
2010/0171688 A1 * 7/2010 Wang ..... G09G 3/3611 345/99
2011/0187730 A1 * 8/2011 Jun ..... G09G 3/36 345/545
2012/0113090 A1 * 5/2012 Minami ..... G09G 3/3648 345/213
2013/0050159 A1 * 2/2013 Wang ..... G09G 3/20 345/204
2013/0187843 A1 * 7/2013 Iwamoto ..... G09G 3/3688 345/100
2014/0198086 A1 * 7/2014 Cheng ..... G09G 3/20 345/209

FOREIGN PATENT DOCUMENTS

JP 2007-264368 A 10/2007

* cited by examiner

*Primary Examiner* — Dismery Mercedes
(74) *Attorney, Agent, or Firm* — Kubotera & Associates, LLC

(57) ABSTRACT

A display device includes display panel includes a first source driver including a first input terminal and a first output terminal connected to the display panel; a first gate driver including a first input-output terminal, a second input-output terminal connected to the first input-output terminal, and a second output terminal connected to the display panel; a timing controller including a first terminal for outputting or inputting a first signal to or from the first input-output terminal and a second terminal; a first signal line connected to the first terminal; a second signal line connected to the second terminal; and a third signal line connected to the first source driver and the timing controller for transmitting a second signal indicating a display direction of the image data. The first source driver operates according to the first signal from the first terminal or the second terminal selected.

7 Claims, 16 Drawing Sheets

91

| Scanning start point | LRb | UDb | STV |
|---|---|---|---|
| Upper left | Low | Low | STV1 |
| Lower left | Low | High | STV2 |
| Upper right | High | Low | STV1 |
| Lower right | High | High | STV2 |

FIG. 9

DISPLAY DEVICE AND SOURCE DRIVER

BACKGROUND OF THE INVENTION AND RELATED ART STATEMENT

The present invention relates to a display device and a source driver. In particular, the present invention relates to a display device suitable for performing an offset cancelling of an amplifier element disposed in each driver regardless of a scanning direction, and to a source driver disposed in the display device.

In a conventional liquid crystal display device, a source driver and a gate driver are provided for driving TFTs (Thin Film Transistor) of a liquid crystal panel. In general, a property of the source driver and the gate driver tends to be affected by an offset voltage of an amplifier element disposed in the source driver and the gate driver. In an extreme case, the offset voltage may cause deterioration of the liquid crystal panel. In a conventional technique (an offset cancelling), in order to minimize the influence of the offset voltage, an offset canceller may be provided for inverting an input polarity of the amplifier element (refer to Patent Reference).

Patent Reference: Japanese Patent Publication No. 2007-264368

The conventional technique for inverting the input polarity includes a dot inversion method, in which the input polarity is inverted per one line, a two line inversion method, in which the input polarity is inverted per two lines, and a frame inversion method, in which the input polarity is inverted per frame. FIG. 12 is a timing chart showing an example of a signal processing operation of a driver driving control circuit of the conventional liquid crystal display device.

As shown in FIG. 12, in each of the dot inversion method, the two line inversion method, and the frame inversion method, it is configured such that the input polarity of the first line is inverted per frame. In order to invert the input polarity of the first line per frame, it is necessary to generate a POL signal and a strove signal (referred to as a STV signal). The POL signal is generated for selecting the polarity of each line between positive and negative. The strove signal is generated for identifying a start point of the frame.

If the STV signal is not input properly, the input polarity is not correctly inverted at the start point of the frame. As a result, it is difficult to properly perform the offset cancelling, so that the desired polarity is not obtained for each line. Accordingly, when the STV signal is not input properly, it is difficult to properly display on the conventional liquid crystal display unit.

In the conventional liquid crystal display device, it is desired that the gate driver is configured to be capable of switching in a scanning direction (a up and down scanning direction), and the source driver is configured to be capable of switching a driving direction (a left and right scanning direction).

If the conventional liquid crystal display device is configured such that the control direction is not switched between the scanning direction and the driving direction, the liquid display panel of the conventional liquid crystal display device may be designed according to a predefined driving direction. Accordingly, it is possible to design the gate driver and the source driver accordingly. In this case, it is possible to shear the STV signal for the gate driver and the source driver.

On the other hand, when the conventional liquid crystal display device is configured such that the control direction is switched between the scanning direction and the driving direction, as disclosed in Patent Reference, it is necessary to input the STV signal separately to the gate driver and the source driver, so that the start point of the frame is properly defined.

In the conventional liquid crystal display device, when the STV signal is sheared for the gate driver and the source driver, it is difficult to properly switch the scanning direction (the up and down scanning direction) in the gate driver and the driving direction (the left and right scanning direction) in the source driver as explained below with reference to FIGS. 13 to 16.

FIG. 13 is a block diagram showing a driver driving control circuit of the liquid crystal panel disposed in the conventional liquid crystal display device upon scanning in a forward scanning direction. FIG. 13 illustrates a transmission path of the STV signal in the forward scanning direction in the driver driving control circuit.

As shown in FIG. 13, the driver driving control circuit includes a liquid crystal panel 71; a timing controller 72; gate drivers 731 to 73*n*; source drivers 741 to 74*m*; an STV signal wiring portion 75 for transmitting the STV signal; and an LRb wiring portion 76 for transmitting an LRb signal for defining the left and right scanning direction.

In the driver driving control circuit shown in FIG. 13, the gate drivers 731 to 73*n*, the source drivers 741 to 74*m*; and the STV signal wiring portion 75 are arranged such that the STV signal is processed at the start point of the frame. Further, the LRb wiring portion 76 is arranged such that the left and right scanning direction can be selected with the LRb signal for defining the left and right scanning direction.

It should be noted that the forward scanning direction (with a left upper start point of the liquid crystal panel 71) is defined as a direction of scanning from the gate driver 731 to the gate driver 73*n* and a direction of scanning from the source driver 741 to the source driver 74*m*, and an reverse scanning direction (with a right lower start point of the liquid crystal panel 71) is defined as an opposite direction to the forward scanning direction.

An operation of the driver driving control circuit shown in FIG. 13 will be explained next. When the scanning is performed in the forward scanning direction, the STV signal output from the timing controller 72 is processed in the order from the gate driver 731 to the gate driver 73*n*. Further, at the same time when the STV signal is input into the gate driver 731, the STV signal output from the timing controller 72 is input into and processed in the order from the source driver 741 to the source driver 74*m*.

FIG. 14 is a timing chart showing the operation of the driver driving control circuit of the liquid crystal panel disposed in the conventional liquid crystal display device upon scanning in the forward scanning direction. In FIG. 14, the STV signal input into the gate driver 731 shown in FIG. 13 is designated with STVb, and the STV signal input into the source drivers 741 to 74*m* shown in FIG. 13 is designated with STVs.

As shown in FIG. 14, the STV signal is input into the gate driver 731 and the source drivers 741 to 74*m* at the start point of one frame. Accordingly, it is possible to normally perform the offset cancelling per frame in the gate drivers 731 to 73*n* and the source drivers 741 to 74*m*.

In the conventional liquid crystal display device having the configuration shown in FIG. 13, however, when the liquid crystal panel is configured such that the forward scanning direction is switched to the reverse scanning direction, the STV signal is not input into the source drivers 741 to 74*m* at the start point of one frame.

FIG. 15 is a block diagram showing the driver driving control circuit of the liquid crystal panel disposed in the conventional liquid crystal display device upon scanning in the reverse scanning direction. FIG. 15 illustrates a transmission path of the STV signal in the reverse scanning direction in the driver driving control circuit.

As shown in FIG. 15, upon scanning in the reverse scanning direction, the STV signal is input into in an order from the gate driver 73*n*, the gate driver 73*n*-1, to the gate driver 731. Afterward, the STV signal is input into the source drivers 741 to 74*m*.

FIG. 16 is a timing chart showing the operation of the driver driving control circuit of the liquid crystal panel disposed in the conventional liquid crystal display device upon scanning in the reverse scanning direction. In FIG. 16, the STV signal input into the gate driver 73*n* shown in FIG. 15 is designated with STVd, and the STV signal input into the source drivers 741 to 74*m* shown in FIG. 15 is designated with STVs.

As shown in FIG. 16, the STV signal STVd is input at a timing different from that of the STV signal STVs. More specifically, the STV signal STVs is input at an end point of one frame.

As described above, it is necessary to input the STV signal at the start point of the frame for properly performing the offset cancelling. When the STV signal is input at the end point of the frame, it is difficult to obtain the desired polarity, thereby deteriorating the liquid crystal panel.

In the conventional liquid crystal display device, the STV signal wiring portion is sheared between the gate drivers and the source drivers. Accordingly, when the control direction of the scanning direction and the driving direction is switched in the liquid crystal panel, the STV signal is not processed at the start point of the frame, and is processed at the end point of the frame. Accordingly, it is difficult to obtain the desired polarity, thereby deteriorating the liquid crystal panel. It appears difficult to solve the problems in the conventional liquid crystal display device.

In view of the problems of the conventional liquid crystal display device described above, an object of the present invention is to provide a display device capable of solving the problems of the conventional liquid crystal display device. In the present invention, it is possible to switch the control direction of scanning of a liquid crystal panel after the liquid crystal panel is designed while a STV signal wiring portion is sheared between gate drivers and source drivers.

Further objects and advantages of the invention will be apparent from the following description of the invention.

SUMMARY OF THE INVENTION

In order to attain the objects described above, according to a first aspect of the present invention, a display device includes a display panel; a first source driver; a first gate driver; a timing controller; a first signal line; a second signal line; and a third signal line.

According to the first aspect of the present invention, the first source driver includes a first input terminal and a first output terminal. The first output terminal is connected to the display panel. The first gate driver includes a first input-output terminal, a second input-output terminal, and a second output terminal. The second input-output terminal is connected to the first input-output terminal, so that a signal can be transmitted inside the first gate driver. The second output terminal is connected to the display panel.

According to the first aspect of the present invention, the timing controller includes a first terminal and a second terminal. The first terminal is provided for outputting or inputting a first signal indicating a start point of a frame of image data to be displayed on the display panel to or from the first input-output terminal. The second terminal is provided for inputting or outputting the first signal from or to the second input-output terminal.

According to the first aspect of the present invention, the first signal line is connected to the first terminal, so that a signal can be transmitted with the first input-output terminal. The second signal line is connected to the second terminal, so that a signal can be transmitted with the second input-output terminal. The third signal line is connected to the first source driver and the timing controller for transmitting a second signal indicating a display direction of the image data.

According to the first aspect of the present invention, the first source driver is configured to operate according to the first signal transmitted from one of the first terminal and the second terminal selected according to the second signal.

According to a second aspect of the present invention, a source driver is provided for operating upon receiving image data output from a timing controller, a first signal indicating a start point of a frame of the image data, and a second signal indicating a display direction of the image data. The source driver is configured to receive a plurality of first signals from a plurality of output terminals of the first signals included in the timing controller. Further, the source driver is configured to select one of the first signals according to the second signal, so that the source driver uses the one of the first signals for an internal operation.

According to a third aspect of the present invention, a selection unit is provided for selecting and receiving an STV signal for the source driver from an STV signal line connected to one of a first gate driver and an n-th gate driver. Accordingly, with the same driver arrangement, it is possible to perform an offset cancelling in either scanning direction.

According to the present invention, in the display device, the wiring portion of the STV signal is sheared between the gate drivers and the source drivers. When the control direction of scanning of the liquid crystal panel is switched, the STV signal is processed at the start point of the frame. Accordingly, it is possible to obtain the desired polarity, and prevent the liquid crystal panel from being deteriorated. Accordingly, it is possible to switch the control direction of scanning of the liquid crystal panel after the liquid crystal panel is designed while the STV signal is sheared between gate drivers and source drivers.

BRIEF DESCRIPTION OF THE DRAWINGS

FIG. 9 is a logic number table showing an example of a signal processing operation of the driver driving control circuit of the display device upon scanning in the forward scanning direction and the reverse scanning direction according to the fourth embodiment of the present invention;

DETAILED DESCRIPTION OF PREFERRED EMBODIMENTS

Hereunder, preferred embodiments of the present invention will be explained with reference to the accompanying drawings.

First Embodiment

Figure 1:
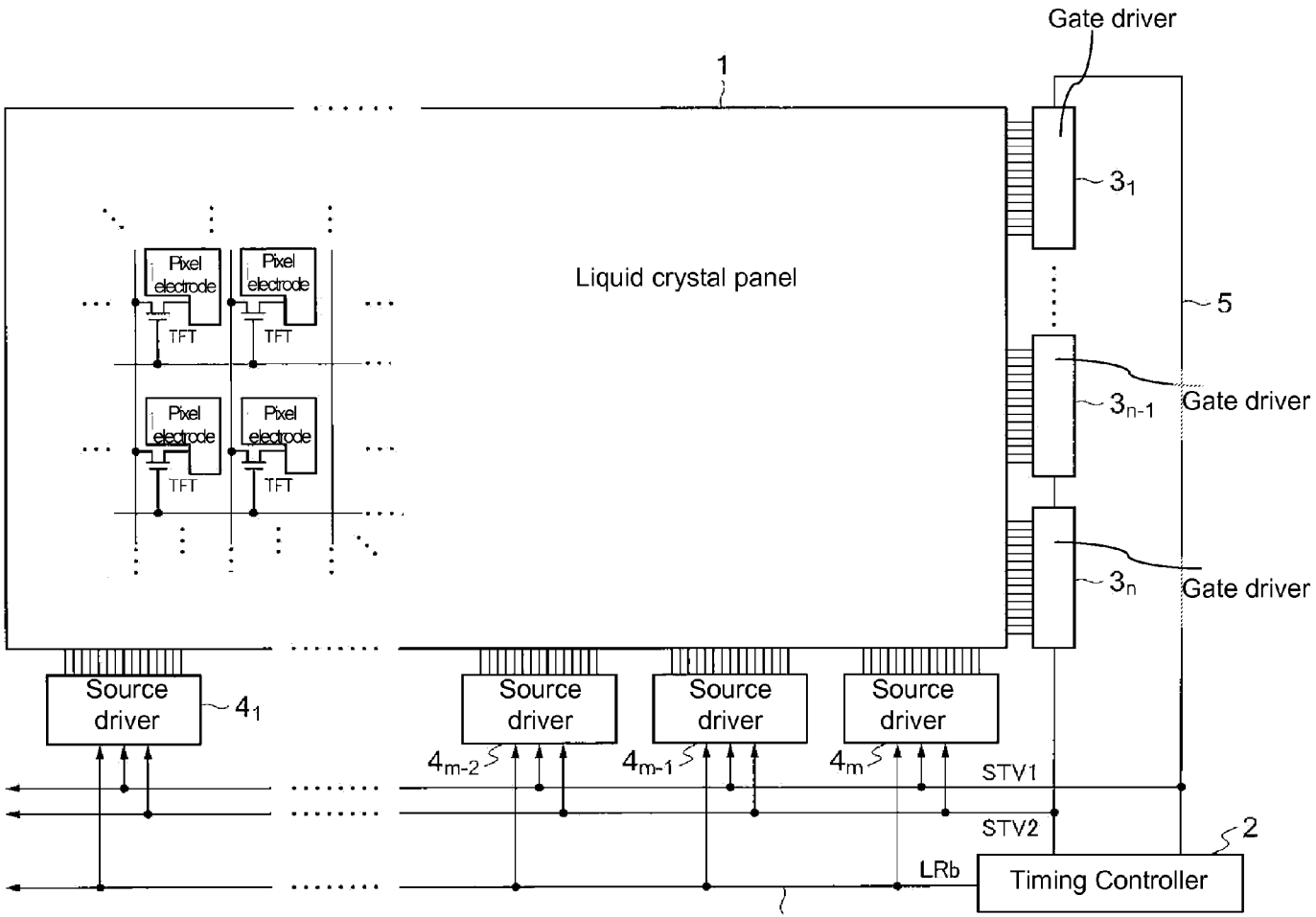
FIG. 1 is a block diagram showing an example of a configuration of a driver driving control circuit of a display device according to a first embodiment of the present invention.

A first embodiment of the present invention will be explained. FIG. 1 is a block diagram showing an example of a configuration of a driver driving control circuit of a display device according to a first embodiment of the present invention.

As shown in FIG. 1, the driver driving control circuit includes a liquid crystal display panel 1; a timing controller 2; gate drivers 31 to 3*n*; source drivers 41 to 4*m*; an STV signal wiring portion 5; and an LRb scanning direction selection signal wiring portion 6 as a direction instruction signal line. It should be noted that the LRb scanning direction selection signal wiring portion 6 is provided as a wiring portion of a switching signal for switching a left and right data transfer direction.

More specifically, in the first embodiment, the driver driving control circuit is composed of the gate drivers 31 to 3*n*, the source drivers 41 to 4*m*, the STV signal wiring portion 5, and the LRb scanning direction selection signal wiring portion 6. The driver driving control circuit is configured to control the drive of the gate drivers 31 to 3*n* and the source drivers 41 to 4*m* according to a signal transmitted from the timing controller 2.

In the first embodiment, the liquid crystal display panel 1 has an effective display region formed of TFTs (Thin Film Transistors) and pixel electrodes. A gate of each of the TFTs is connected to the gate drivers 31 to 3*n*, and a source of each of the TFTs is connected to the source drivers 41 to 4*m*. Further, scan lines (gate lines) and data lines (source lines) are arranged in a matrix pattern, so that a pixel is formed at a crossing portion of the matrix pattern. A switching device is disposed at each of the pixels.

In the first embodiment, the timing controller 2 is disposed in a control unit (not shown). The control unit is configured to receive an external signal transmitted from an external device including, for example, a computer, a television set, a video displaying device, a DVD playing device, a navigation device, and the like. Further, the control unit is configured to output display data, a control signal, and the like to the gate drivers 31 to 3*n* and the source drivers 41 to 4*m* through a signal line (not shown). Further, the control unit is configured to output a control signal and the like to the STV signal wiring portion 5 and the LRb scanning direction selection signal wiring portion 6 through the timing controller 2. Further, the control unit is configured to transmit an STV signal indicating a start point of a frame and an LRb signal indicating a driving direction (a left and right scanning direction) to the gate drivers 31 to 3*n* and the source drivers 41 to 4*m*.

Figure 13:
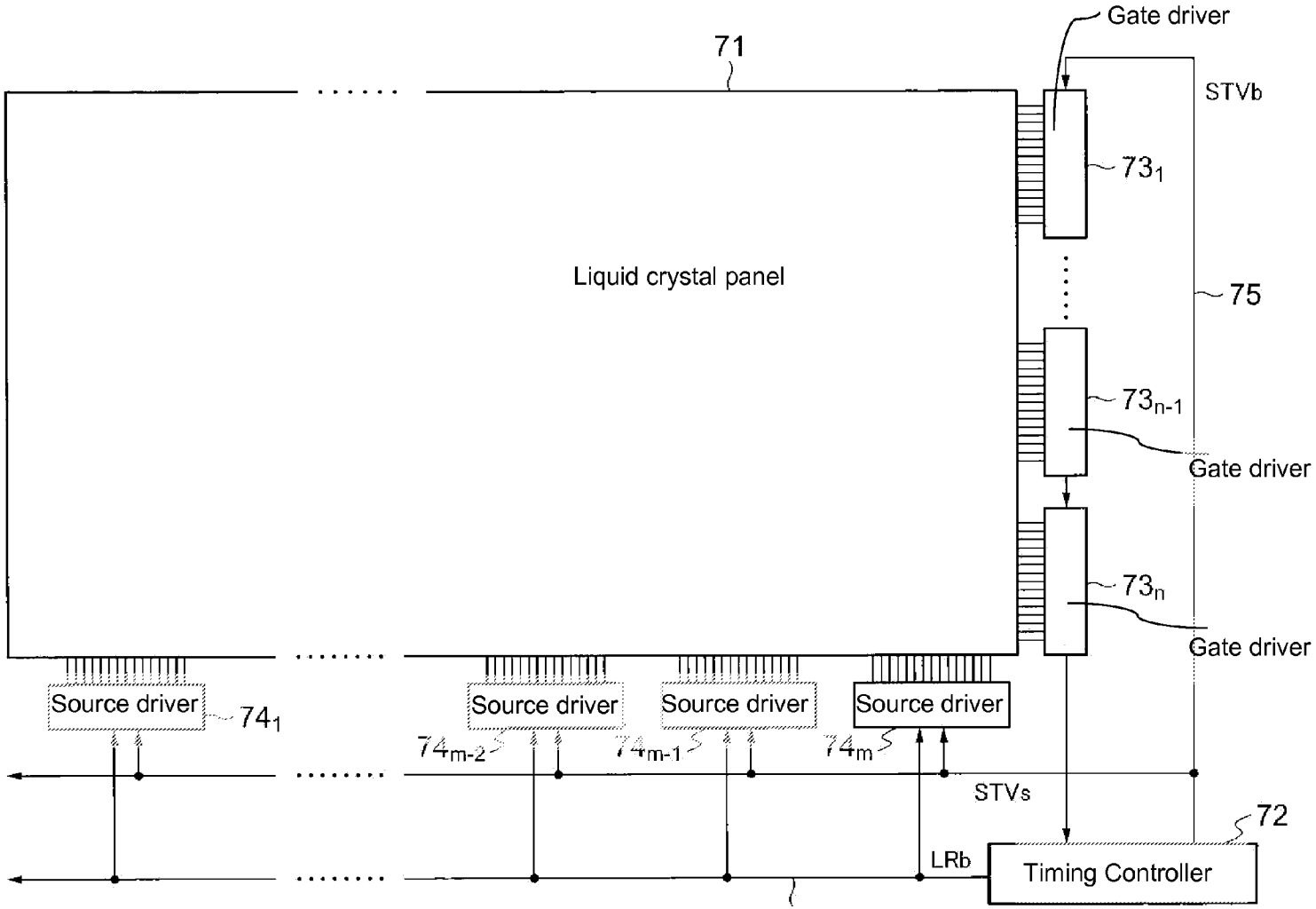
FIG. 13 is a block diagram showing an example of a configuration of the driver driving control circuit of the conventional display device upon scanning in the forward scanning direction.
Figure 14:
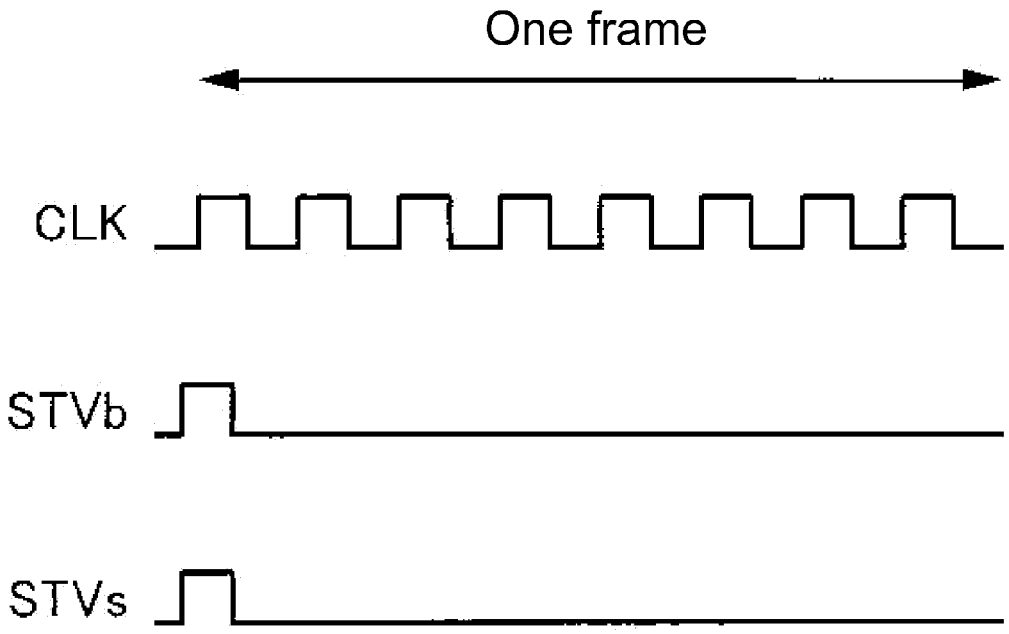
FIG. 14 is a timing chart showing an example of the signal processing operation of the driver driving control circuit of the conventional display device upon scanning in the forward scanning direction.
Figure 15:
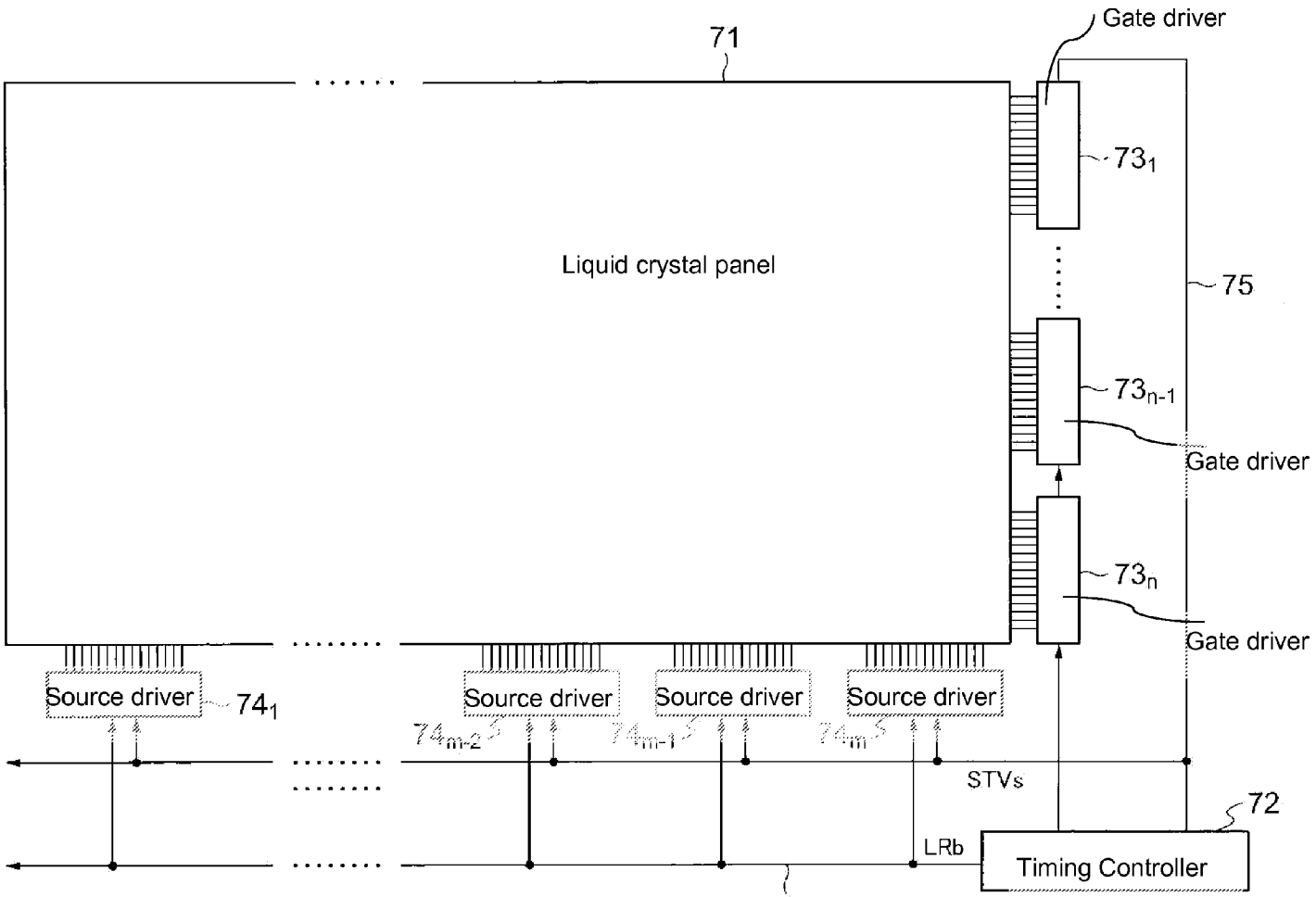
FIG. 15 is a block diagram showing an example of the configuration of the driver driving control circuit of the conventional display device upon scanning in the reverse scanning direction.
Figure 16:
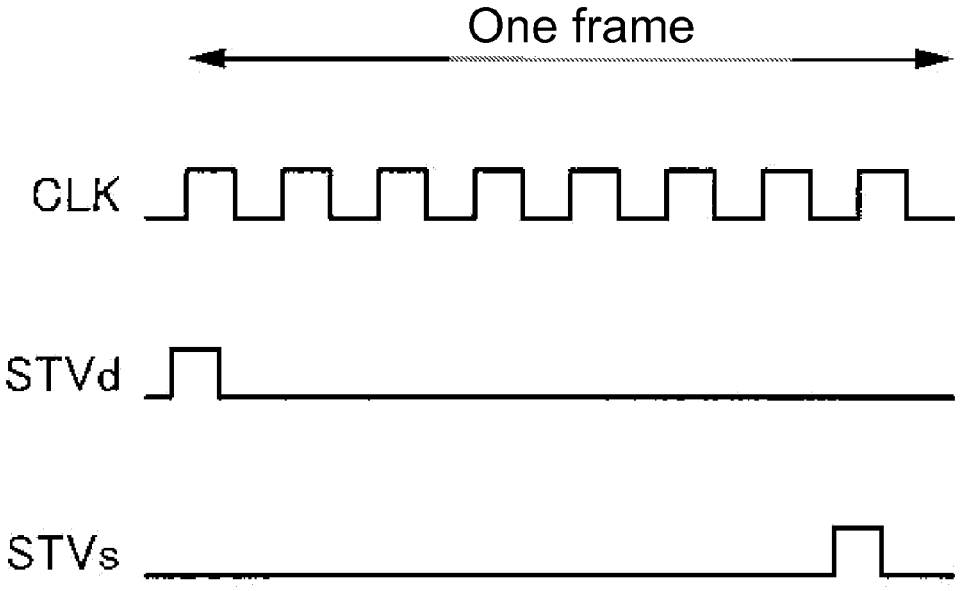
FIG. 16 is a timing chart showing an example of the signal processing operation of the driver driving control circuit of the conventional display device upon scanning in the reverse scanning direction.

In the first embodiment, similar to the driver driving control circuit of the conventional liquid crystal display device shown in FIG. 13, the gate drivers 31 to 3*n*, the source drivers 41 to 4*m*; and the STV signal wiring portion 5 are arranged such that the STV signal is processed at the start point of the frame. Further, it is configured such that the scanning direction can be selected according to the LRb signal indicating the left and right scanning direction.

More specifically, the forward scanning direction (with a panel left upper start point) is defined as a direction in which the scanning is performed from the gate driver 31 to the gate driver 3*n* and from the source driver 41 to the source driver 4*m*. The reverse scanning direction (with a panel right lower start point) is defined as a direction opposite to the forward scanning direction. Further, it is configured such that the up and down scanning direction can be selected according to the LRb signal indicating the left and right scanning direction.

For example, when the LRb signal from the timing controller 2 has a low level "0", the display data at the gate drivers 31 to 3*n* and the source drivers 41 to 4*m* are transmitted in an order from the first output terminal to the output terminal at a larger number (n, m) of the liquid crystal display panel 1 (the down shift, the right shift). On the other hand, when the LRb signal from the timing controller 2 has a high level "1", the display data are transmitted in the opposite direction (the up shift, the left shift).

As described above, in the first embodiment, the LRb scanning direction selection signal wiring portion 6 is provided as the direction instruction signal line for transmitting and inputting the direction instruction signal, which indicates which of the gate driver 31 or the gate driver 3*n* the STV signal is transmitted, to each of the source drivers 41 to 4*m* in parallel.

In the driver driving control circuit shown in FIG. 1, two lines of STV signal wiring portions (a wiring portion STV1 as a first signal line and a wiring portion STV2 as a second signal line) are connected to the source drivers 41 to 4*m*.

Figure 2:
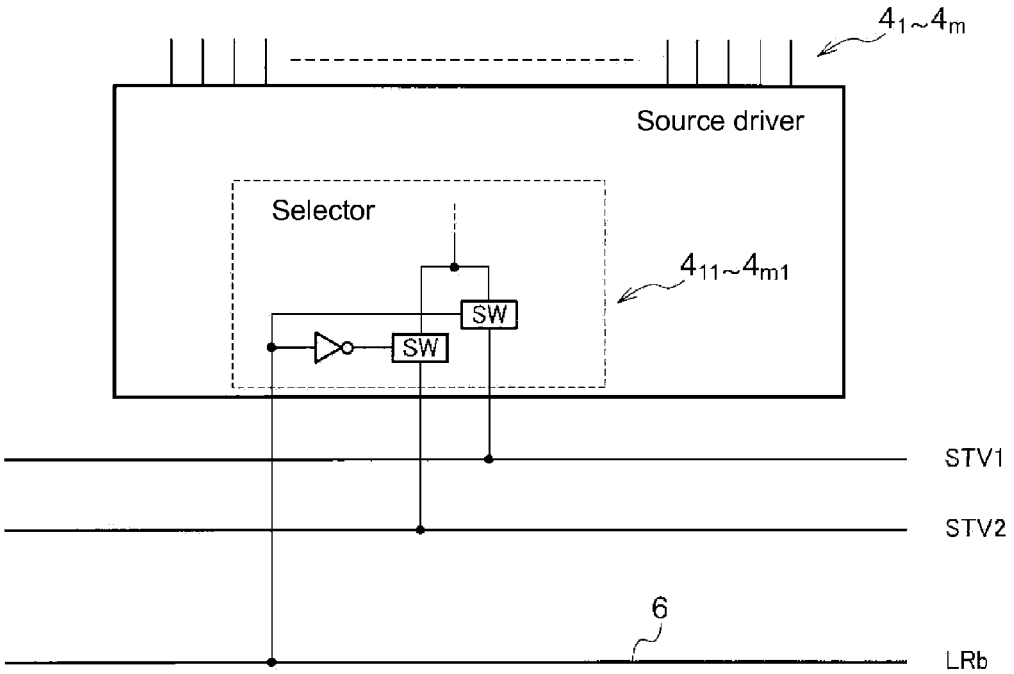
FIG. 2 is a block diagram showing an example of an inside configuration of a selector disposed in a source driver of the display device according to the first embodiment of the present invention.

FIG. 2 is a block diagram showing an example of an inside configuration of selectors 411 to 4*m*1 disposed in the source drivers 41 to 4*m* of the display device according to the first embodiment of the present invention.

As shown in FIG. 2, the source drivers 41 to 4*m* include the selectors 411 to 4*m*1 as the selection units, respectively. Accordingly, it is possible to select one of the wiring portion STV1 and the wiring portion STV2 as the STV signal wiring portion according to the scanning direction.

As shown in FIG. 2, each of the selectors 411 to 4*m*1 includes a switching element SW formed of an NOT circuit, an MOSFET, and the like. Each of the selectors 411 to 4*m*1 is configured to select the wiring portion STV 1 as the connection destination when the output of the LRb signal line identifying the scanning direction has the low level "0". Each of the selectors 411 to 4*m*1 is configured to select the wiring portion STV 2 as the connection destination when the output of the LRb signal line identifying the scanning direction has the high level "1".

As described above, in the first embodiment, different from the driver driving control circuit of the conventional liquid crystal display device shown in FIG. 13, the driver driving control circuit includes the two separate wiring portions (the wiring portion STV 1 and the wiring portion STV 2) for transmitting the STV signal to the source drivers 41 to 4*m*. Further, the source drivers 41 to 4*m* include the selectors 411 to 4*m*1 for selecting one of the wiring portion STV 1 and the wiring portion STV 2 according to the scanning direction.

As described above, the forward scanning direction (with the panel left upper start point) is defined as the direction in which the scanning is performed from the gate driver 31 to the gate driver 3*n* and from the source driver 41 to the source driver 4*m*. The reverse scanning direction (with the panel right lower start point) is defined as the direction opposite to the forward scanning direction. Further, the selectors 411 to 4*m*1 are controlled according to the LRb signal.

More specifically, the LRb signal is used for determining the left and right scanning direction. The scanning direction is determined according to the LRb signal, and the selectors 411 to 4*m*1 are provided for selecting one of the wiring portion STV 1 and the wiring portion STV 2 according to the LRb signal. Accordingly, it is possible to control the selectors 411 to 4*m*1 without providing additional terminals.

An operation of the driver driving control circuit of the display device will be explained next with reference to FIGS. 3 and 4.

Figure 3:
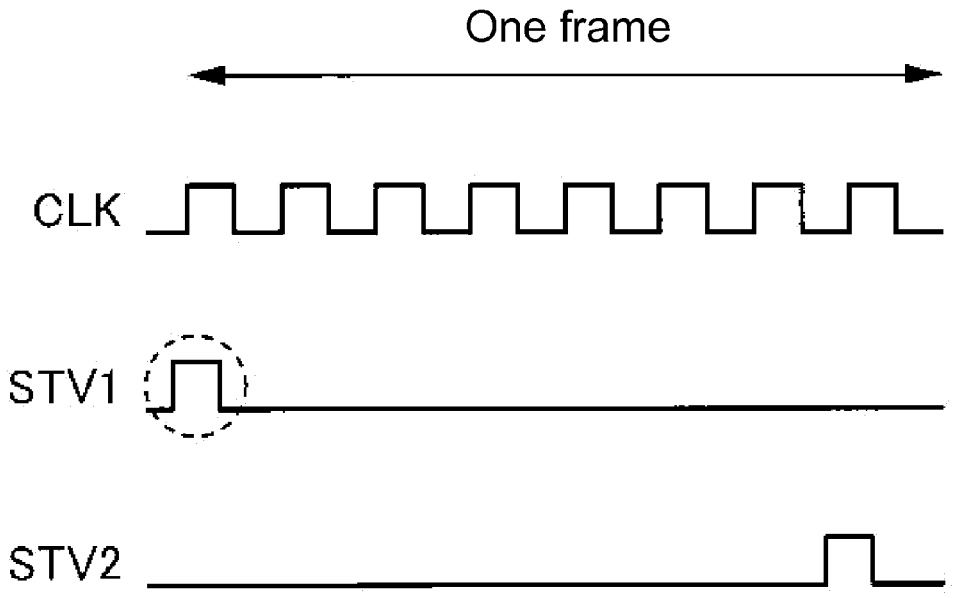
FIG. 3 is a timing chart showing an example of a signal processing operation of the driver driving control circuit of the display device upon scanning in a forward scanning direction according to the first embodiment of the present invention.

FIG. 3 is a timing chart showing an example of a signal processing operation of the driver driving control circuit of the display device upon scanning in the forward scanning direction according to the first embodiment of the present invention. FIG. 4 is a timing chart showing an example of the signal processing operation of the driver driving control circuit of the display device upon scanning in the reverse scanning direction according to the first embodiment of the present invention.

As shown in FIG. 3, the example shows the signal processing operation of the driver driving control circuit of the display device upon scanning in the forward scanning direction. In this case, the selectors 411 to 4*m*1 of the source drivers 41 to 4*m* select the wiring portion STV1. Accordingly, the STV signal output from the timing controller 2 is processed in the order from the gate driver 31 to the gate driver 3*n*. Further, when the STV signal is input into the gate driver 31, the STV signal is input into and processed in each of the source drivers 41 to 4*m*. Accordingly, in the scanning in the forward scanning direction, the STV signal is input into the gate drivers 31 to 3*n* and the source drivers 41 to 4*m* at the start point of one frame.

Figure 4:
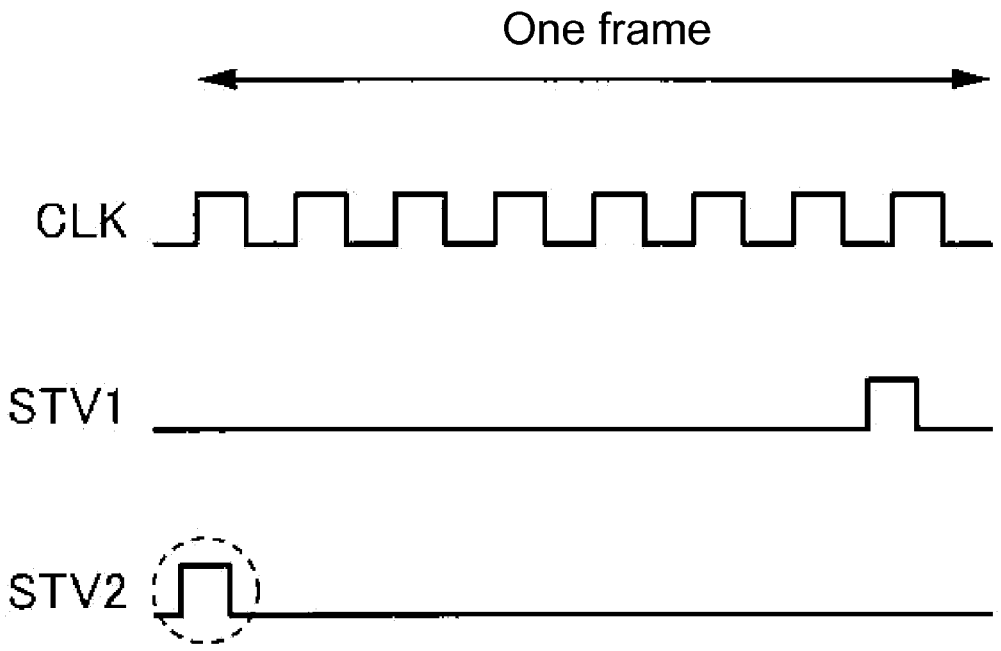
FIG. 4 is a timing chart showing an example of the signal processing operation of the driver driving control circuit of the display device upon scanning in a reverse scanning direction according to the first embodiment of the present invention.

As shown in FIG. 4, the example shows the signal processing operation of the driver driving control circuit of the display device upon scanning in the reverse scanning direction. In this case, the selectors 411 to 4*m*1 of the source drivers 41 to 4*m* select the wiring portion STV2. Accordingly, the STV signal output from the timing controller 2 is processed in the order from the gate driver 3*n* to the gate driver 31. Further, when the STV signal is input into the gate driver 3*n*, the STV signal is input into and processed in each of the source drivers 41 to 4*m*. Accordingly, in the scanning in the reverse scanning direction, the STV signal is input into the gate drivers 31 to 3*n* and the source drivers 41 to 4*m* at the start point of one frame.

As described above, in the first embodiment, the driver driving control circuit of the display device includes the gate drivers 31 to 3*n* and the source drivers 41 to 4*m* each connected to the matrix pattern wiring portion of m×n. The driver driving control circuit of the display device further includes the wiring portion STV1 as the first signal line arranged so that the STV signal is simultaneously input into each of the source drivers 41 to 4*m* when the STV signal is input into the first gate driver 31. The STV signal is input into the first gate driver 31 and is output from the n-th gate driver 3*n* in the first order, so that the STV signal notifies the start point of the frame with the polarity to be inverted relative to each of the gate drivers 31 to 3*n*.

Further, the driver driving control circuit of the display device includes the wiring portion STV2 as the second signal line arranged so that the STV signal is simultaneously input into each of the source drivers 41 to 4*m* when the STV signal is input into the n-th gate driver 3*n*. The STV signal is input into the n-th gate driver 3*n* and is output from the first gate driver 31 in the second order.

Further, the driver driving control circuit of the display device includes the LRb scanning direction selection signal wiring portion 6 as the direction instruction signal line arranged such that the LRb signal as the direction instruction signal, which indicates whether the STV signal is transmitted in the first order or the second order, is transmitted simultaneously to each of the source drivers 41 to 4*m*.

Further, the driver driving control circuit of the display device includes the selectors 411 to 4*m*1 as the selection units for selecting one of the wiring portion STV1 and the wiring portion STV2 according to the LRb signal. The selectors 411 to 4*m*1 are configured to select the wiring portion STV1 to be connected to each of the source drivers 41 to 4*m* when the STV signal is transmitted in the first order. The selectors 411 to 4*m*1 are configured to select the wiring portion STV2 to be connected to each of the source drivers 41 to 4*m* when the STV signal is transmitted in the second order. The selectors 411 to 4*m*1 are disposed inside the source drivers 41 to 4*m*, respectively.

In the first embodiment, in the driver driving control circuit of the display device with the configuration described above, in either of the forward scanning direction or the reverse scanning direction, it is possible to process the STV signal at the start point of one frame. Accordingly, it is possible to normally perform the offset cancelling per frame. Further, it is possible to switch the scanning direction of the liquid crystal display panel 1 after the liquid crystal display panel 1 and the source drivers 41 to 4*n* are mounted.

As described above, in the first embodiment, the driver driving control circuit of the display device includes the two STV signal lines (the wiring portion STV1 and the wiring portion STV2) and the selectors 411 to 4*m*1 in the source drivers 41 to 4*m*, so that it is possible to select one of the two STV signal lines according to the LRb signal. Accordingly, it is possible to process the STV signal at the start point of one frame upon scanning in the reverse scanning direction without providing additional terminals. As a result, when the scanning direction is switched between the forward scanning direction and the reverse scanning direction, it is possible to normally perform the offset cancelling with the simple configuration, thereby prevent the liquid crystal display panel 1 from being deteriorated.

In the driver driving control circuit of the display device in the first embodiment, the wiring portion STV1 and the wiring portion STV2 connected to the source drivers 41 to 4*m* and the LRb scanning direction selection signal wiring portion 6 have open end portions opposite to the side connected to the timing controller 2. The present invention is not limited to the configuration.

Second Embodiment

Figure 5:
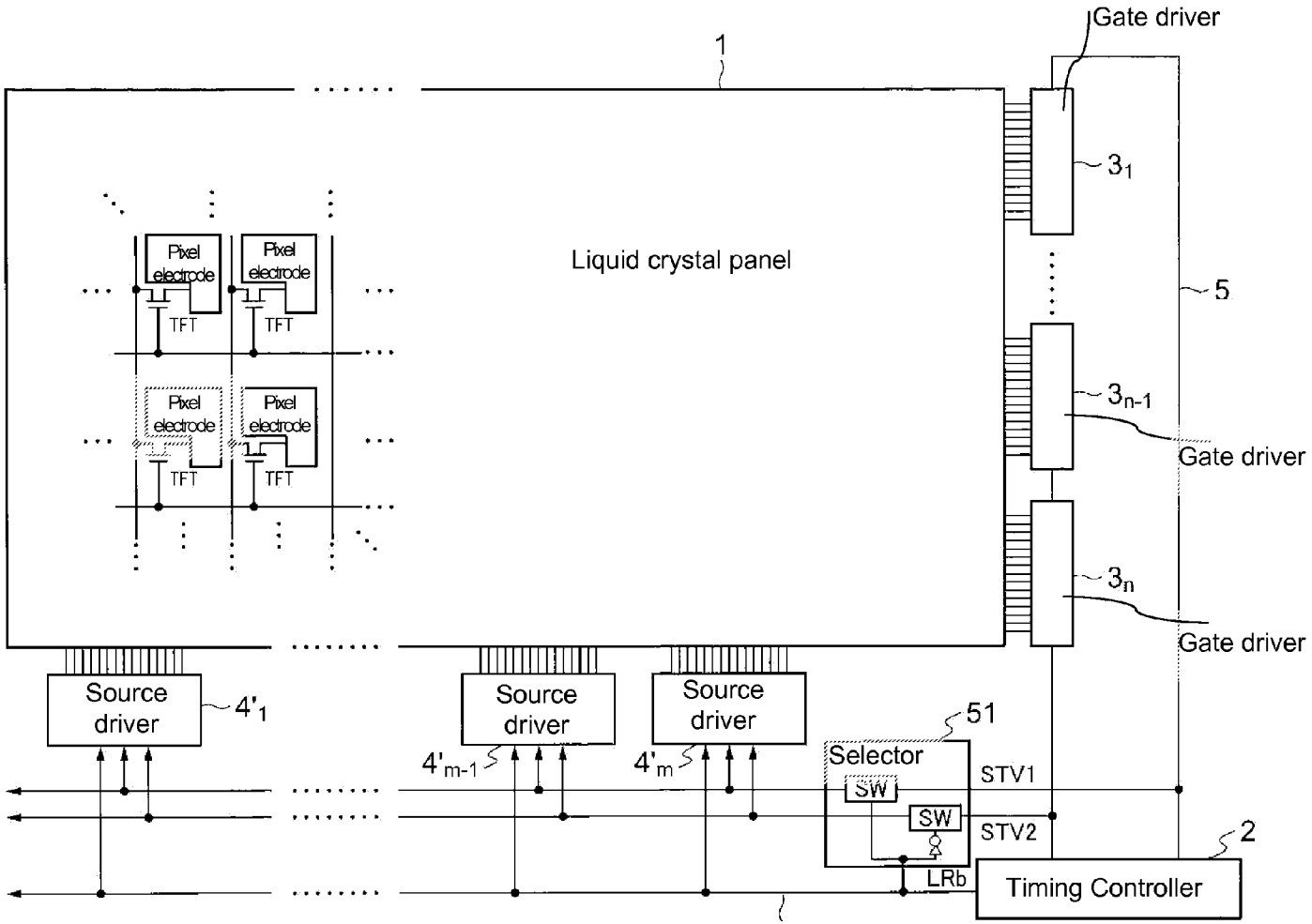
FIG. 5 is a block diagram showing an example of a configuration of a driver driving control circuit of a display device according to a second embodiment of the present invention.

A second embodiment of the present invention will be explained next with reference to FIG. 5. FIG. 5 is a block diagram showing an example of a configuration of a driver driving control circuit of a display device according to the second embodiment of the present invention.

As shown in FIG. 5, different from the driver driving control circuit of the display device in the first embodiment shown in FIG. 1, the driver driving control circuit of the display device in the second embodiment includes a selector 51 disposed outside of source drivers 4'1 to 4'*m*. More specifically, in the driver driving control circuit of the display device shown in FIG. 5, the selector 51 is disposed between the source drivers 4'1 to 4'*m* and the first gate driver 31 and the n-th gate driver 3*n* through the STV signal wiring portion 5.

In the second embodiment, in the driver driving control circuit of the display device shown in FIG. 5 with the configuration as described above, the selector 51 is capable of selecting one of the wiring portion STV1 and the wiring portion STV2 for simultaneously inputting the STV signal to each of the source drivers 4'1 to 4'*m* according to the LRb signal.

Accordingly, it is possible to process the STV signal at the start point of one frame upon scanning in the reverse scanning direction without providing additional terminals. As a result, when the scanning direction is switched between the forward scanning direction and the reverse scanning direction, it is possible to normally perform the offset cancelling with the simple configuration, thereby prevent the liquid crystal display panel 1 from being deteriorated.

Third Embodiment

Figure 6:
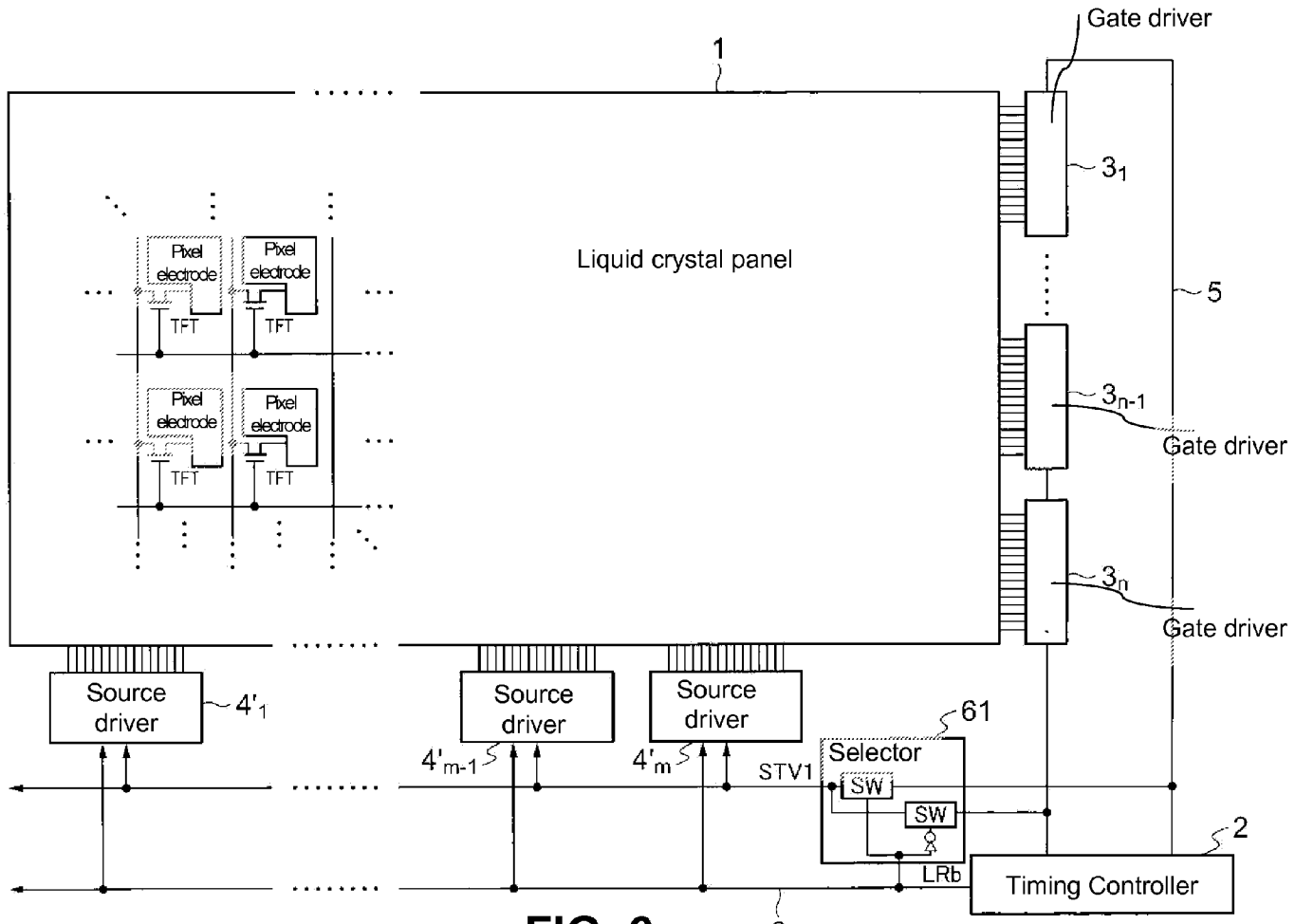
FIG. 6 is a block diagram showing an example of a configuration of a driver driving control circuit of a display device according to a third embodiment of the present invention.

A third embodiment of the present invention will be explained next with reference to FIG. 6. FIG. 6 is a block diagram showing an example of a configuration of a driver driving control circuit of a display device according to the third embodiment of the present invention.

As shown in FIG. 6, different from the driver driving control circuit of the display device in the first embodiment shown in FIG. 1, the driver driving control circuit of the display device in the third embodiment includes a selector 61 disposed outside of the source drivers 4'1 to 4'*m*. Further, in the driver driving control circuit of the display device shown in FIG. 5, only one wiring portion, that is, the wiring portion STV1, is provided for the source drivers 4'1 to 4'*m*.

In the third embodiment, in the driver driving control circuit of the display device shown in FIG. 6, only one wiring portion, that is, the wiring portion STV1, is provided for simultaneously inputting the STV signal to each of the source drivers 4'1 to 4'*m*. Further, the selector 51 is configured to connect the wiring portion STV to one of the first gate driver 31 and the n-th gate driver 3*n* through the STV signal wiring portion 5 according to the LRb signal.

As described above, in the driver driving control circuit of the display device shown in FIG. 6 with the configuration as described above, the selector 61 is capable of selecting one of the first gate driver 31 and the n-th gate driver 3*n* through the STV signal wiring portion 5 as the connection destination of the STV signal to be input simultaneously into each of the source drivers 4'1 to 4'*m* according to the LRb signal.

Accordingly, it is possible to process the STV signal at the start point of one frame upon scanning in the reverse scanning direction without providing additional terminals. As a result, when the scanning direction is switched between the forward scanning direction and the reverse scanning direction, it is possible to normally perform the offset cancelling with the simple configuration, thereby prevent the liquid crystal display panel 1 from being deteriorated.

Fourth Embodiment

Figure 7:
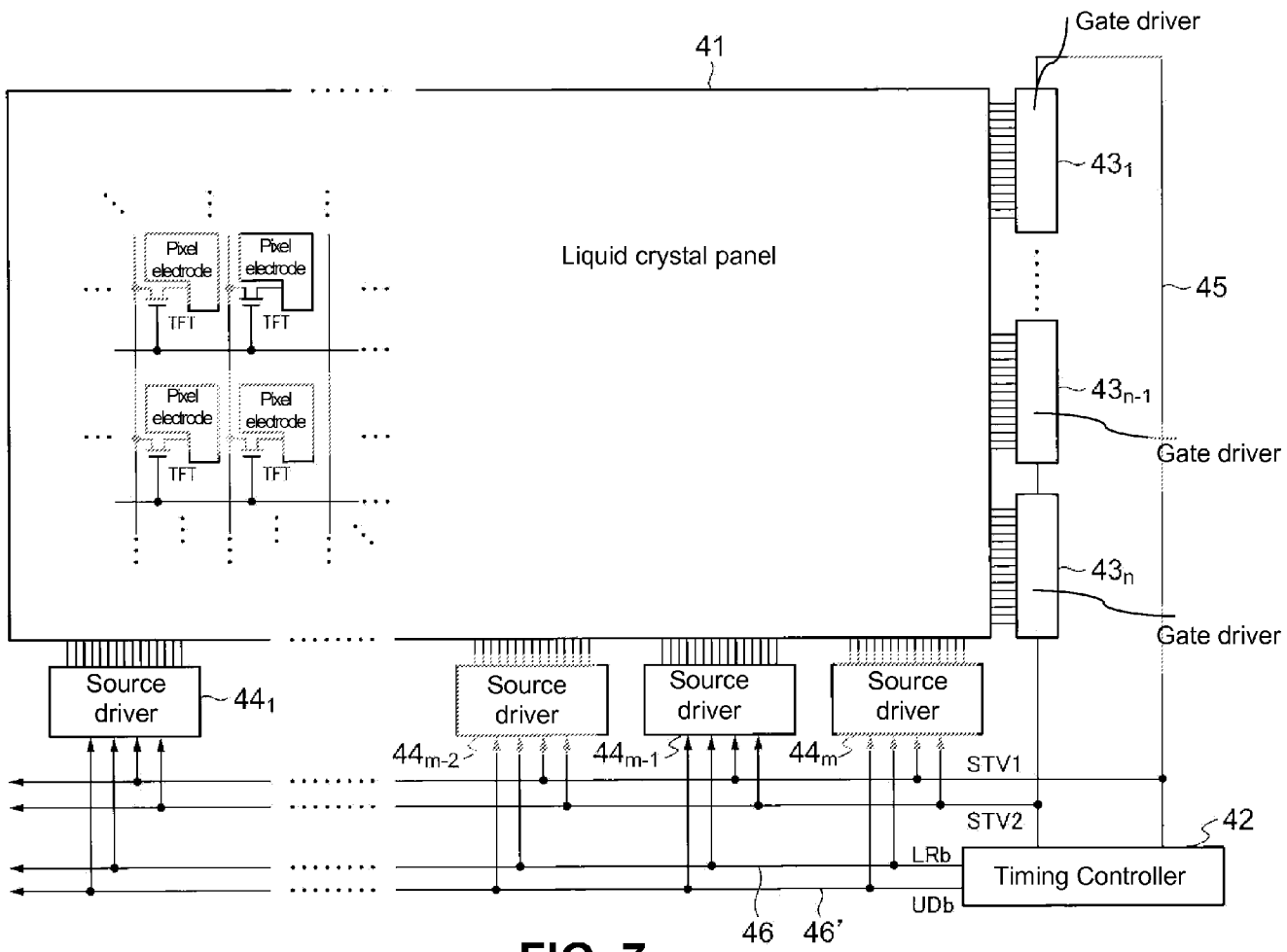
FIG. 7 is a block diagram showing an example of a configuration of a driver driving control circuit of a display device according to a fourth embodiment of the present invention.

A fourth embodiment of the present invention will be explained next with reference to FIG. 7. FIG. 7 is a block diagram showing an example of a configuration of a driver driving control circuit of a display device according to the fourth embodiment of the present invention.

In the driver driving control circuit of the display device shown in FIG. 7, selectors 4411 to 4*m*11 are provided for selecting the connection destination of the STV signal to be input simultaneously into each of source drivers 441 to 44*m* according to the LRb signal for switching the scanning direction in the left and right direction as well as a UDb signal for switching the scanning direction in the up and down direction.

As shown in FIG. 7, the driver driving control circuit includes a liquid crystal display panel 41; a timing controller 42; gate drivers 431 to 43*n*; the source drivers 441 to 44*m*; and an STV signal wiring portion 45. Further, the driver driving control circuit includes an LRb scanning direction selection signal wiring portion 46 as a first direction instruction signal line. It should be noted that the LRb scanning direction selection signal wiring portion 46 is provided as a wiring portion of a switching signal for switching the left and right data transfer direction. Further, the driver driving control circuit includes a UDb scanning direction selection signal wiring portion 46' as a second direction instruction signal line. It should be noted that the UDb scanning direction selection signal wiring portion 46' is provided as a wiring portion of a switching signal for switching the up and down data transfer direction.

More specifically, in the fourth embodiment, the driver driving control circuit is composed of the gate drivers 431 to 43*n*, the source drivers 441 to 44*m*, the STV signal wiring portion 45, and the LRb scanning direction selection signal wiring portion 46. The driver driving control circuit is configured to control the drive of the gate drivers 431 to 43*n* and the source drivers 441 to 44*m* according to a signal transmitted from the timing controller 42.

In the fourth embodiment, the liquid crystal panel 41 has a configuration similar to that of the liquid crystal display panel 1 in the first embodiment shown in FIG. 1. Further, an operation of controlling the drive of the gate drivers 431 to 43*n* and the source drivers 441 to 44*m* and the display of the liquid crystal panel 41 are similar to those of the display device in the first embodiment shown in FIG. 1. Accordingly, detailed explanations thereof are omitted.

In the fourth embodiment, similar to the driver driving control circuit of the display device in the first embodiment shown in FIG. 1, and the driver driving control circuit of the conventional liquid crystal display device shown in FIG. 13, the gate drivers 31 to 3*n*, the source drivers 441 to 44*m*; and the STV signal wiring portion 45 are arranged such that the STV signal is processed at the start point of the frame. Further, it is configured such that the scanning direction can be selected according to the LRb signal indicating the left and right scanning direction.

For example, when the LRb signal has the low level "0", the timing controller 42 transmits the display data to the liquid crystal panel 41 in an order from the first output terminal to the output terminal at a larger number (the right shift, the right scanning direction). On the other hand, when the LRb signal has the high level "1", the display data are transmitted in the opposite direction (the left shift, the left scanning direction).

Further, in the fourth embodiment, the driver driving control circuit of the display device is configured such that the up and down scanning direction can be selected according to the UDb signal indicating the up and down scanning direction.

For example, when the UDb signal has the low level "0", the timing controller 42 transmits the display data to the liquid crystal panel 41 in an order from the first output terminal to the output terminal at a larger number (the down shift, the down scanning direction). On the other hand, when the LRb signal has the high level "1", the display data are transmitted in the opposite direction (the up shift, the up scanning direction).

Figure 8:
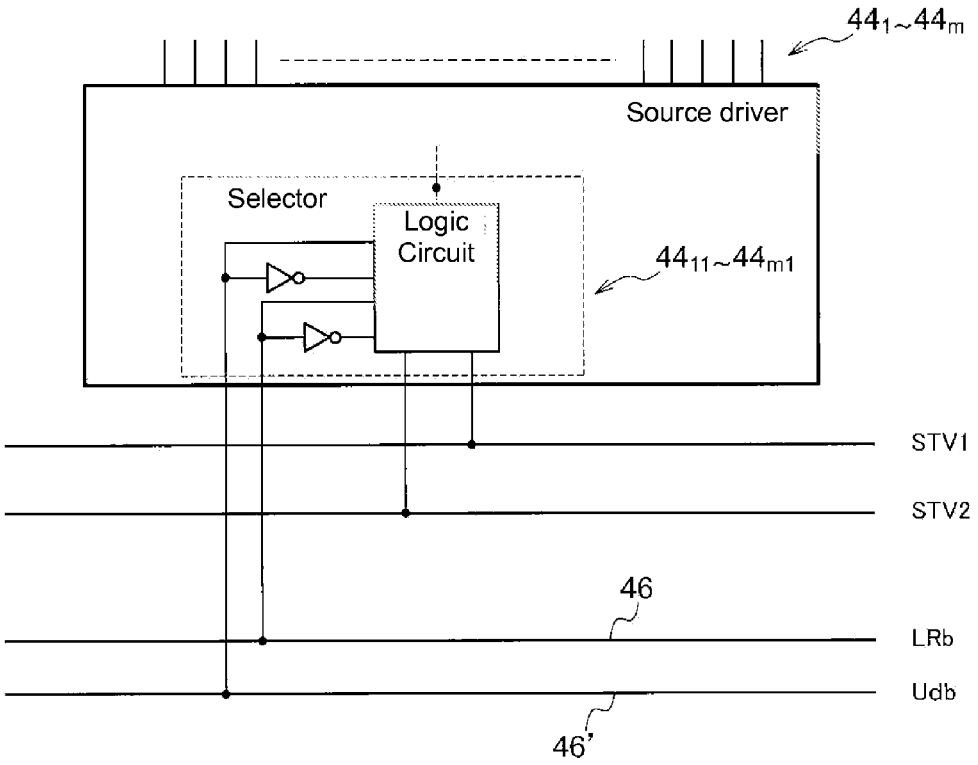
FIG. 8 is a block diagram showing an example of an inside configuration of a selector disposed in a source driver of the display device according to the fourth embodiment of the present invention.

In the driver driving control circuit of the display device shown in FIG. 7, two lines of the STV signal wiring portions (the wiring portion STV1 and the wiring portion STV2) are connected to the source drivers 441 to 44*m*. Further, the source drivers 441 to 44*m* include selectors 4411 to 44*m*1 as shown in FIG. 8 as the selection units, respectively. Accordingly, it is possible to select one of the wiring portion STV1 and the wiring portion STV2 as the STV signal wiring portion according to the scanning direction.

FIG. 8 is a block diagram showing an example of an inside configuration of the selectors 4411 to 44*m*1 disposed in the source drivers 441 to 44*m* of the display device according to the fourth embodiment of the present invention.

As shown in FIG. 8, each of the selectors 4411 to 44*m*1 includes a logic circuit and the like formed of an NOT circuit, an MOSFET, and the like. Each of the selectors 411 to 4*m*1 is configured to select the wiring portion STV 1 as the connection destination when the output of the LRb signal line identifying the scanning direction has the low level "0". Each of the selectors 411 to 4*m*1 is configured to select one of the wiring portion STV1 and the wiring portion STV 2 as the connection destination of the STV signal according to the signal level of the LRb signal and the UDb signal as shown in a logic number table 91 shown in FIG. 9.

FIG. 9 is the logic number table 91 showing an example of the signal processing operation of the driver driving control circuit of the display device upon scanning in the forward scanning direction and the reverse scanning direction according to the fourth embodiment of the present invention.

As shown in FIG. 9, when the scanning start point is located at upper left, the output of the LRb scanning direction selection signal wiring portion 46 and the UDb scanning direction selection signal wiring portion 46' has the low level "0". In this case, the selectors 4411 to 44*m*1 select the wiring portion STV1 as the connection destination of the STV signal. When the scanning start point is located at lower left, the output of the LRb scanning direction selection signal wiring portion 46 has the low level "0", and the output of the UDb scanning direction selection signal wiring portion 46' has the high level "1". In this case, the selectors 4411 to 44*m*1 select the wiring portion STV2 as the connection destination of the STV signal.

Further, as shown in FIG. 9, when the scanning start point is located at upper right, the output of the LRb scanning direction selection signal wiring portion 46 has the high level "1", and the output of the UDb scanning direction selection signal wiring portion 46' has the low level "0". In this case, the selectors 4411 to 44*m*1 select the wiring portion STV1 as the connection destination of the STV signal. When the scanning start point is located at lower right, the output of the LRb scanning direction selection signal wiring portion 46 and the UDb scanning direction selection signal wiring portion 46' has the high level "1". In this case, the selectors 4411 to 44*m*1 select the wiring portion STV2 as the connection destination of the STV signal.

As described above, in the fourth embodiment, different from the driver driving control circuit of the conventional liquid crystal display device shown in FIG. 13, the driver driving control circuit of the display device includes the two separate wiring portions (the wiring portion STV 1 and the wiring portion STV 2) for transmitting the STV signal to the source drivers 441 to 44*m*. Further, the source drivers 441 to 44*m* include the selectors 4411 to 44*m*1 for selecting one of the wiring portion STV 1 and the wiring portion STV 2 according to the scanning direction.

Further, in the fourth embodiment, the LRb signal and the UDb signal are used for controlling the selectors 4411 to 44*m*1. The left and right scanning direction is determined according to the LRb signal, and the up and down scanning direction is determined according to the UDb signal. Further, the selectors 4411 to 44*m*1 are provided for selecting the scanning direction and one of the wiring portion STV 1 and the wiring portion STV 2 according to the combination of the LRb signal and the UDb signal. Accordingly, it is possible to control the selectors 4411 to 44*m*1 without providing additional terminals.

In the fourth embodiment, an operation of the driver driving control circuit of the display device is similar to that of the driver driving control circuit of the display device in the first embodiment shown in FIGS. 3 and 4. More specifically, regardless of the scanning direction, the STV signal is input into the gate drivers 431 to 43*n* and the source drivers 441 to 44*m* at the start point of one frame.

As described above, in the fourth embodiment, the driver driving control circuit of the display device shown in FIG. 7 includes the gate drivers 431 to 43*n* and the source drivers 441 to 44*m* each connected to the matrix pattern wiring portion of m×n. The driver driving control circuit of the display device further includes the wiring portion STV1 as the first signal line arranged so that the STV signal is simultaneously input into each of the source drivers 441 to 44*m* when the STV signal is input into the first gate driver 431. The STV signal is input into the first gate driver 431 and is output from the n-th gate driver 43*n* in the first order, so that the STV signal notifies the start point of the frame with the polarity to be inverted relative to each of the gate drivers 431 to 43*n*.

Further, the driver driving control circuit of the display device includes the wiring portion STV2 as the second signal line arranged so that the STV signal is simultaneously input into each of the source drivers 441 to 44*m* when the STV signal is input into the n-th gate driver 43*n*. The STV signal is input into the n-th gate driver 43*n* and is output from the first gate driver 431 in the second order.

Further, the driver driving control circuit of the display device includes the LRb scanning direction selection signal wiring portion 46 as the first direction instruction signal line arranged such that the LRb signal as the first direction instruction signal, which notifies the driving direction of the source drivers 441 to 44*m*, is transmitted simultaneously to each of the source drivers 441 to 44*m*.

Further, the driver driving control circuit of the display device includes the UDb scanning direction selection signal wiring portion 46' as the second direction instruction signal line arranged such that the UDb signal as the second direction instruction signal, which notifies the driving direction of the gate drivers 431 to 43*n*, is transmitted simultaneously to each of the source drivers 441 to 44*m*.

Further, the driver driving control circuit of the display device includes the selectors 4411 to 44*m*1 as the selection units for selecting one of the wiring portion STV1 and the wiring portion STV2 according to the combination of the LRb signal and the UDb signal. The selectors 4411 to 44*m*1 are configured to select the wiring portion STV1 to be connected to each of the source drivers 441 to 44*m* when the STV signal is transmitted in the first order. The selectors 4411 to 44*m*1 are configured to select the wiring portion STV2 to be connected to each of the source drivers 441 to 44*m* when the STV signal is transmitted in the second order. The selectors 4411 to 44*m*1 are disposed inside the source drivers 441 to 44*m*, respectively.

Accordingly, in the first embodiment, the driver driving control circuit of the display device shown in FIG. 7 is capable of scanning the liquid crystal panel 41 in all scanning directions from not only the upper left scanning start point and the lower right scanning start point, but also the upper right scanning start point and the lower left scanning start point.

More specifically, when the scanning start point is at upper left (the LRb signal has the low level and the UDb signal has the low level), the STV signal is processed from the gate driver 431. In this case, the wiring portion STV1 is selected, so that the STV signal from the wiring portion STV1 is processed in the source drivers 441 to 44*m*. When the scanning start point is at lower left (the LRb signal has the low level and the UDb signal has the high level), the STV signal is processed from the gate driver 43*n*. In this case, the wiring portion STV2 is selected, so that the STV signal from the wiring portion STV2 is processed in the source drivers 441 to 44*m*.

Accordingly, in the driver driving control circuit of the display device shown in FIG. 7, the STV signal is processed at the start point of one frame with either the upper left scanning start point or the lower left scanning start point. It should be noted that the scanning direction is the up direction with the upper left scanning start point, while the scanning direction is the down direction with the lower left scanning start point.

In the driver driving control circuit of the display device shown in FIG. 1, the LRb signal is used as the selector signal of the wiring portion STV1 and the wiring portion STV2. Accordingly, it is possible to perform the scanning at only two scanning start points (the upper left scanning start point and the lower right scanning start point). On the other hand, in the driver driving control circuit of the display device shown in FIG. 7, the UDb signal in addition to the LRb signal are used as the selector signals of the wiring portion STV1 and the wiring portion STV2. Accordingly, it is possible to perform the scanning in all directions. As a result, the STV signal is processed in the source drivers 441 to 44*m* at the start point of the frame in all scanning directions.

As described above, in the first embodiment, in the driver driving control circuit of the display device shown in FIG. 7, the UDb signal in addition to the LRb signal are used as the selector signals of the wiring portion STV1 and the wiring portion STV2. Accordingly, it is possible to obtain an effect similar to that in the first embodiment regardless of the scanning direction. As a result, in all scanning directions, it is possible to normally perform the offset cancelling. In particular, in a device to be used while switching the scanning direction, it is possible to obtain a prominent effect.

Fifth Embodiment

Figure 10:
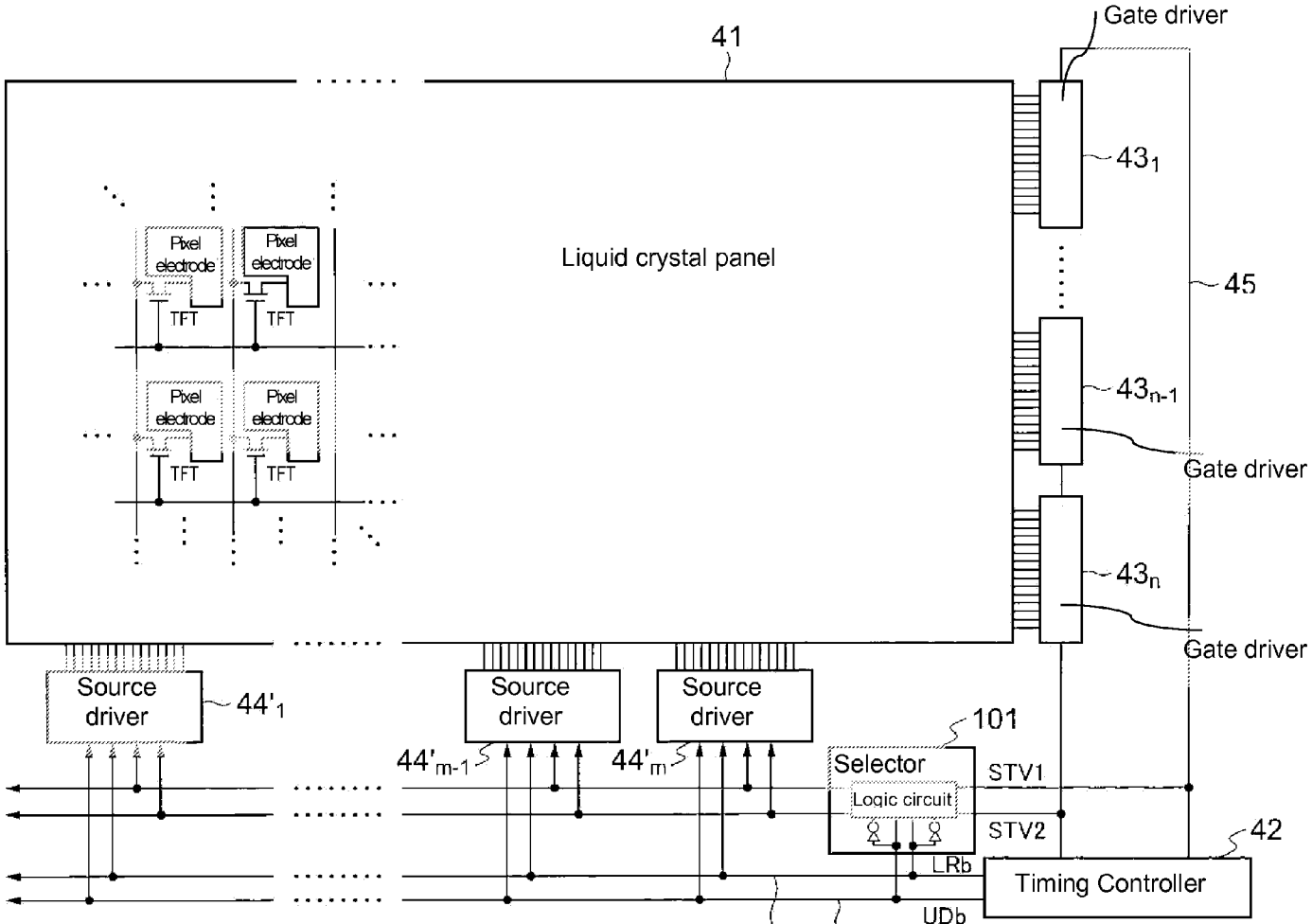
FIG. 10 is a block diagram showing an example of a configuration of a driver driving control circuit of a display device according to a fifth embodiment of the present invention.

A fifth embodiment of the present invention will be explained next with reference to FIG. 10. FIG. 10 is a block diagram showing an example of a configuration of a driver driving control circuit of a display device according to the fifth embodiment of the present invention.

In the fourth embodiment, as shown in FIG. 7, the selectors 4411 to 44*m*1 are disposed inside the source drivers 441 to 44*m*. In the fifth embodiment, as shown in FIG. 10, a selector 101 is disposed outside source drivers 44'1 to 44'*m*. More specifically, the driver driving control circuit of the display device includes the selector 101 disposed between the source drivers 44'1 to 4'*m* and the first gate driver 431 and the n-th gate driver 43*n* through the STV signal wiring portion 45.

In the fifth embodiment, in the driver driving control circuit of the display device shown in FIG. 10 with the configuration as described above, the selector 101 is capable of selecting one of the wiring portion STV1 and the STV wiring portion STV2 as the connection path of the STV signal to be input simultaneously into each of the source drivers 44'1 to 44'*m* according to the LRb signal and the UDb signal.

Accordingly, it is possible to process the STV signal at the start point of one frame upon scanning in all scanning directions without providing additional terminals. As a result, when the driver driving control circuit of the display device switches the scanning direction in all scanning directions, it is possible to normally perform the offset cancelling with the simple configuration, thereby prevent the liquid crystal display panel 1 from being deteriorated.

Sixth Embodiment

Figure 11:
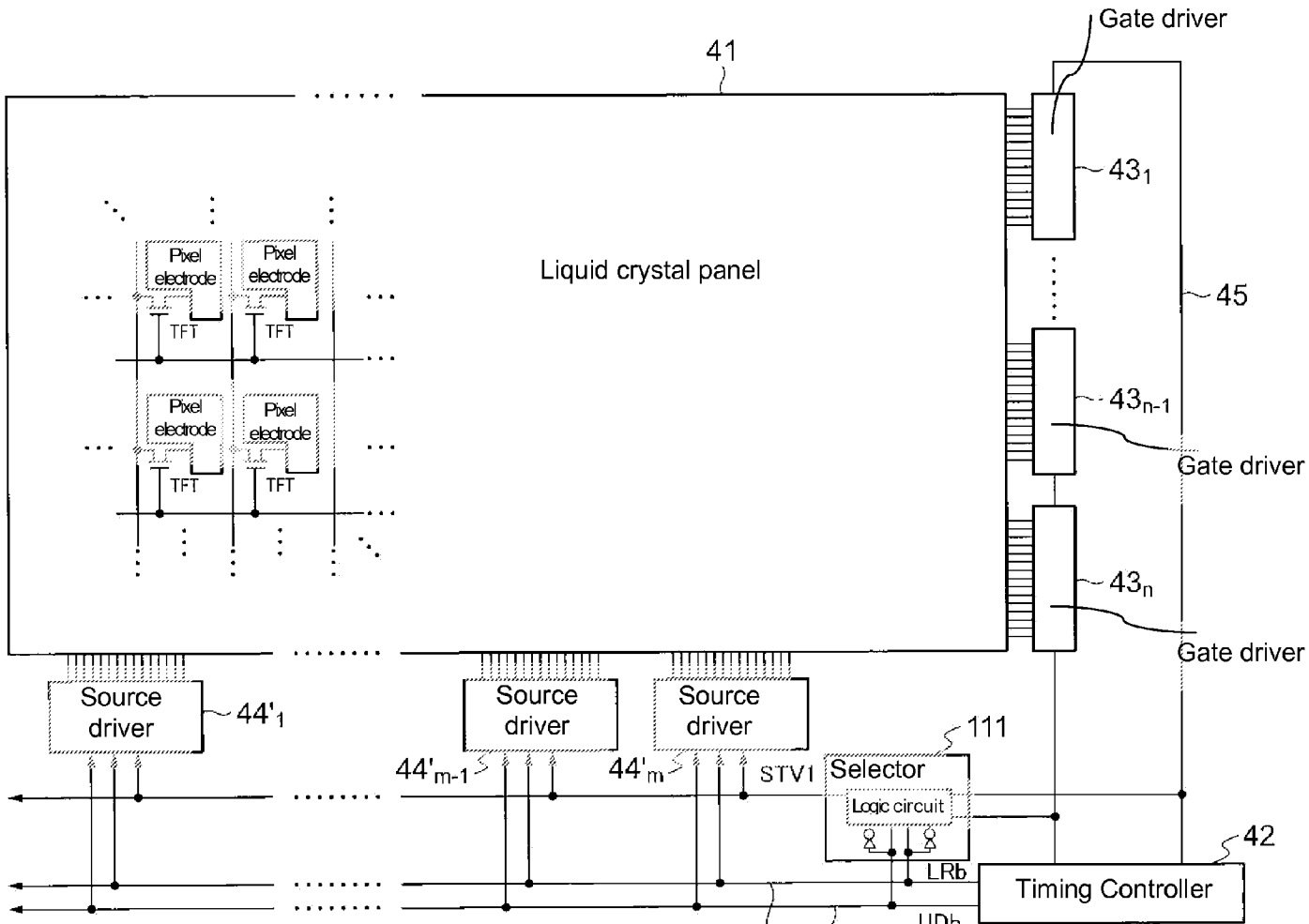
FIG. 11 is a block diagram showing an example of a configuration of a driver driving control circuit of a display device according to a sixth embodiment of the present invention.
Figure 12:
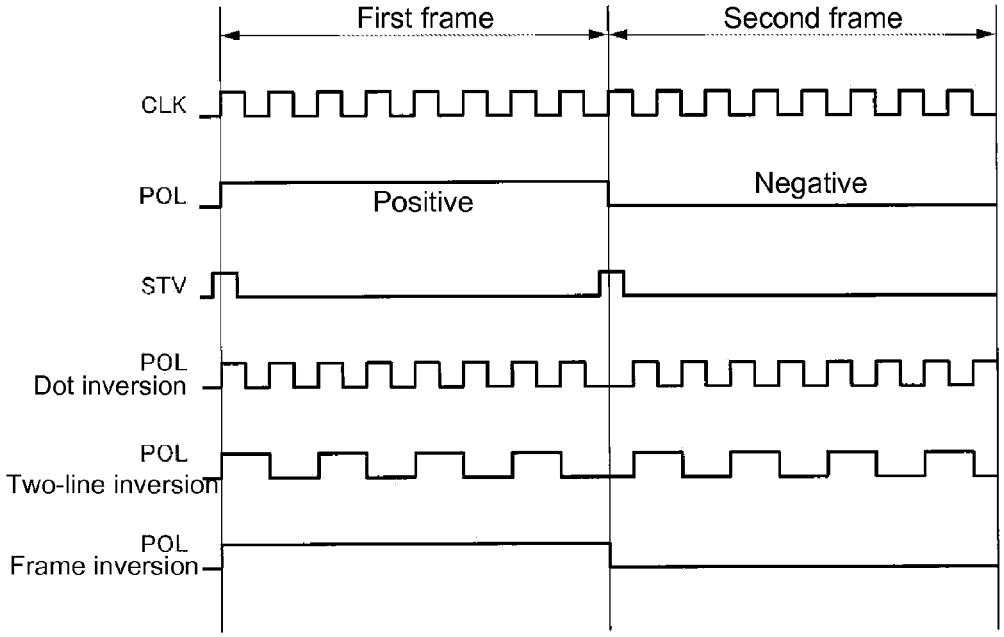
FIG. 12 is a timing chart showing an example of a signal processing operation of a driver driving control circuit of a conventional display device.

A fifth embodiment of the present invention will be explained next with reference to FIG. 11. FIG. 11 is a block diagram showing an example of a configuration of a driver driving control circuit of a display device according to the sixth embodiment of the present invention.

In the fourth embodiment, as shown in FIG. 7, the selectors 4411 to 44*m*1 are disposed inside the source drivers 441 to 44*m*. In the sixth embodiment, as shown in FIG. 11, a selector 111 is disposed outside the source drivers 44'1 to 44'*m*. Further, only one wiring portion, that is, the wiring portion STV1, is provided for simultaneously inputting the STV signal to each of the source drivers 44'1 to 44'*m*.

More specifically, the driver driving control circuit of the display device includes only one wiring portion, that is, the wiring portion STV1, is provided for simultaneously inputting the STV signal to each of the source drivers 44'1 to 44'*m*. Further, the selector 111 is capable of connecting the wiring portion STV1 to one of the first gate driver 431 and the n-th gate driver 43*n* through the STV signal wiring portion 45.

In the sixth embodiment, in the driver driving control circuit of the display device shown in FIG. 11 with the configuration as described above, the selector 111 is capable of selecting and connecting one of the first gate driver 431 and the n-th gate driver 43*n* as the connection destination of the STV signal to be input simultaneously into each of the source drivers 44'1 to 44'*m* through the STV signal wiring portion 45 according to the LRb signal and the UDb signal.

Accordingly, it is possible to process the STV signal at the start point of one frame upon scanning in all scanning directions without providing additional terminals. As a result, when the driver driving control circuit of the display device switches the scanning direction in all scanning directions, it is possible to normally perform the offset cancelling with the simple configuration, thereby prevent the liquid crystal display panel 1 from being deteriorated.

As described above, in the first to sixth embodiments, the driver driving control circuit of the display device includes the selector. The selector is configured to be capable of selecting the STV signal line connected to one of the first driver and the n-th gate driver, so that the STV signal for the source drivers is input through the STV signal line.

For example, when the forward scanning is started from the upper left scanning start point and the reverse scanning is started from the lower right scanning start point, it is possible to normally perform the offset cancelling on the same driver arrangement in both the forward scanning and the reverse scanning using the LRb signal used for switching the left direction scanning and the right direction scanning.

Further, when the control signal UDb is used as the selector control signal for selecting the wiring portion STV1 or the wiring portion STV2 corresponding to the up and down scanning direction, it is possible to normally perform the offset cancelling in all scanning directions without changing the driver arrangement.

It should be noted that the present invention is not limited to the first to sixth embodiments described above, and may be modified within the scope of the invention. For example, in the logic number table 91 shown in FIG. 9, with regard to the relationship between the scanning start point and the STV signal, the logic of the LRb signal and the UDb signal may be switched as far as the STV signal is processed at the start point of one frame.

The disclosure of Japanese Patent Application No. 2013-130017, filed on Jun. 20, 2013, is incorporated in the application by reference.

While the invention has been explained with reference to the specific embodiments of the invention, the explanation is illustrative and the invention is limited only by the appended claims.

What is claimed is:

1. A display device, comprising:

a display panel;

first to m-th source drivers (m is a natural integer greater than three) each including a first input terminal and a first output terminal connected to the display panel;

first to n-th gate drivers (n is a natural integer greater than three);

a timing controller including a first terminal and a second terminal, said first terminal being provided for outputting or inputting a first signal indicating a start point of a frame of image data to be displayed on the display panel;

a first signal line connected to the first terminal of the timing controller and each of the first input terminals of the first to m-th source drivers in parallel so that the first signal is transmitted to each of the first to m-th source drivers in parallel;

a second signal line connected to the second terminal of the timing controller and each of the first input terminals of the first to m-th source drivers in parallel so that the first signal is transmitted to each of the first to m-th source drivers in parallel; and a third signal line connected to the first to m-th source drivers and the timing controller for transmitting a second signal indicating a display direction of the image data, wherein said first to m-th source drivers are configured to operate according to the first signal transmitted from one of the first terminal of the timing controller and the second terminal of the timing controller selected according to the second signal, and each of said first to m-th source drivers further includes a selection unit configured to select the first signal transmitted from the first terminal of the timing controller or the second terminal of the timing controller according to the second signal.

2. The display device according to claim 1, wherein said third signal line is arranged to transmit the second signal indicating a vertical direction of a scanning line as a display direction of an image or a lateral direction of a data line as an input direction of the image data.

3. The display device according to claim 1, wherein said selection unit is configured to select one of the first signal line and the second signal line according to the second signal so that the one of the first signal line and the second signal line is connected to the first to m-th source drivers.

4. The display device according to claim 1, wherein said selection unit is configured to select one of the first signal line and the second signal line according to the second signal so that the one of the first signal line and the second signal line is connected to the third signal line connected to the first to m-th source drivers.

5. The display device according to claim 1, wherein said timing controller including the first terminal for outputting or inputting the first signal indicating a reference of offset cancelling of the first source driver or the first gate driver.

6. A source driver, comprising:

an input terminal; and an output terminal connected to a display panel of a display device, wherein said input terminal is arranged to receive image data output from a timing controller, a plurality of first signals indicating a start point of a frame of the image data, and a second signal indicating a display direction of the image data, said input terminal is configured to receive the first signal in parallel through separate signal lines, and said source driver further includes a selection unit configured to select one of the first signals according to the second signal.

7. The source driver according to claim 6, wherein said input terminal is arranged to receive the second signal indicating a vertical direction of a scanning line as a display direction of an image or a lateral direction of a data line as an input direction of the image data.

* * * * *